United States Patent [19]

Diamond

[11] Patent Number: 4,502,257

[45] Date of Patent: Mar. 5, 1985

[54] STRUCTURAL MODULES

[76] Inventor: Gary Diamond, 3525 Sawtelle #101, Los Angeles, Calif. 90066

[21] Appl. No.: 230,899

[22] Filed: Feb. 2, 1981

[51] Int. Cl.[3] ..... E04B 1/32

[52] U.S. Cl. ..... 52/80; 52/81; 52/DIG. 10

[58] Field of Search ..... 52/80, 82, DIG. 10, 52/81; 46/1 L

[56] References Cited

U.S. PATENT DOCUMENTS

| | | | |
|---|---|---|---|
| 3,299,585 | 1/1967 | Wilkins | 52/80 X |
| 3,302,359 | 2/1967 | Alleaume . | |
| 3,568,381 | 3/1971 | Hale | 52/81 |
| 3,774,358 | 11/1973 | Hale | 52/81 |
| 3,931,697 | 1/1976 | Pearce | 52/80 |

FOREIGN PATENT DOCUMENTS

| | | | |
|---|---|---|---|
| 643465 | 2/1964 | Belgium | 52/80 |

*Primary Examiner*—Carl D. Friedman

[57] ABSTRACT

A family of modular construction units, formed from a plurality of curved surfaces, which may be interconnected with others of like shape to form a structure defining a volume of space.

18 Claims, 34 Drawing Figures

Fig. 4
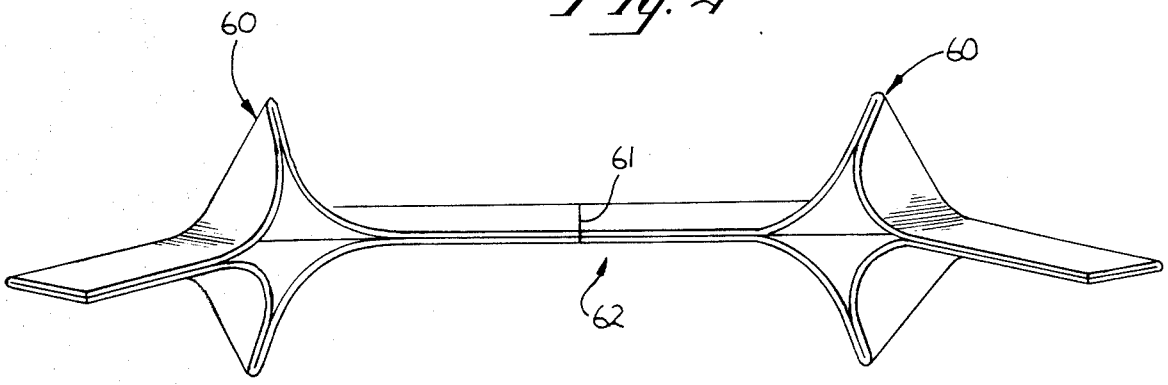
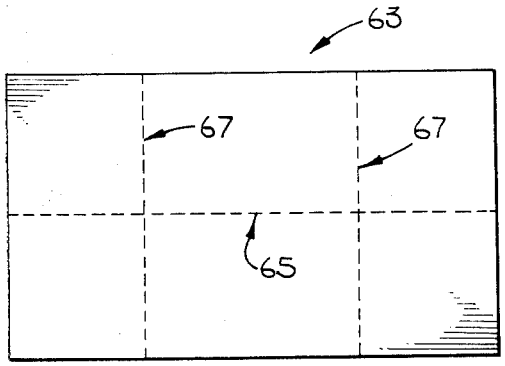
Fig. 4a
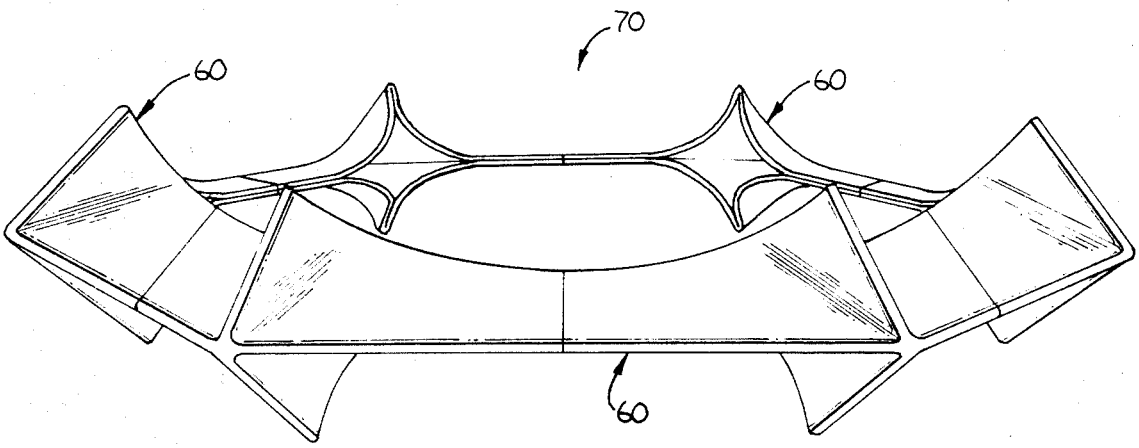
Fig. 5

Fig. 14
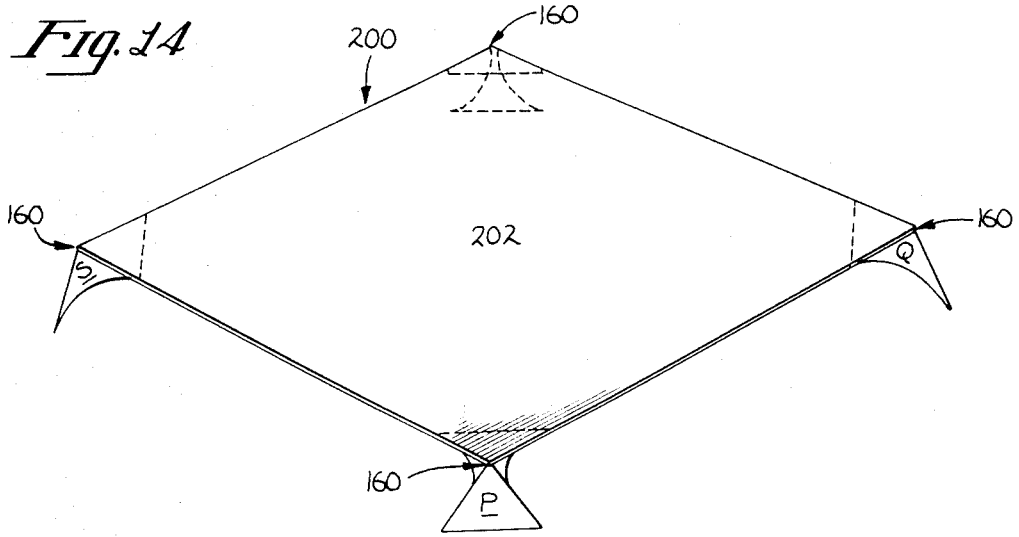
Fig. 15
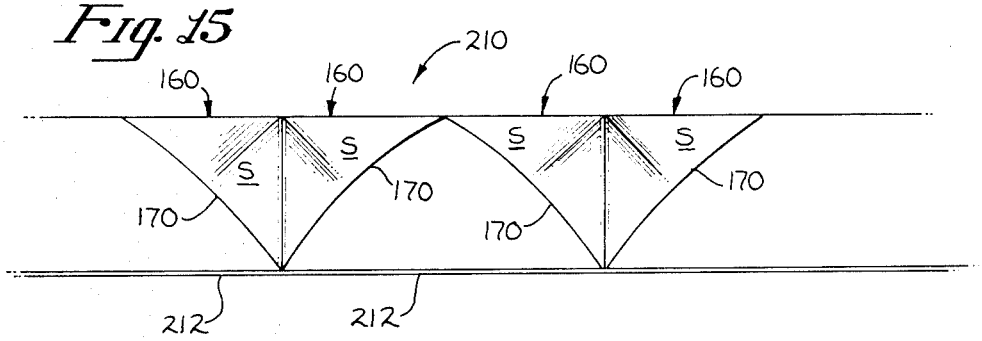
Fig. 16
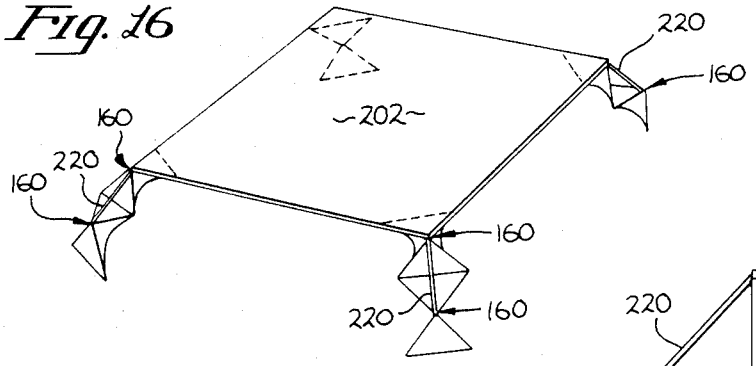
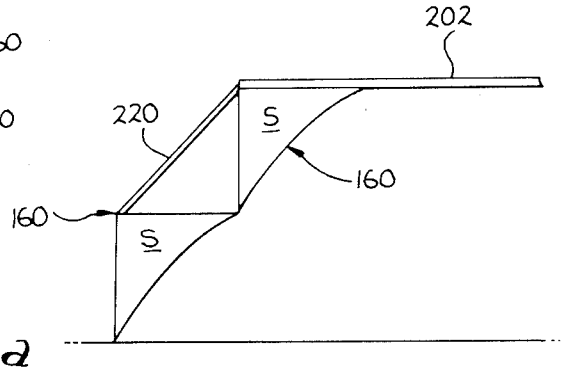
Fig. 16a

Fig. 17
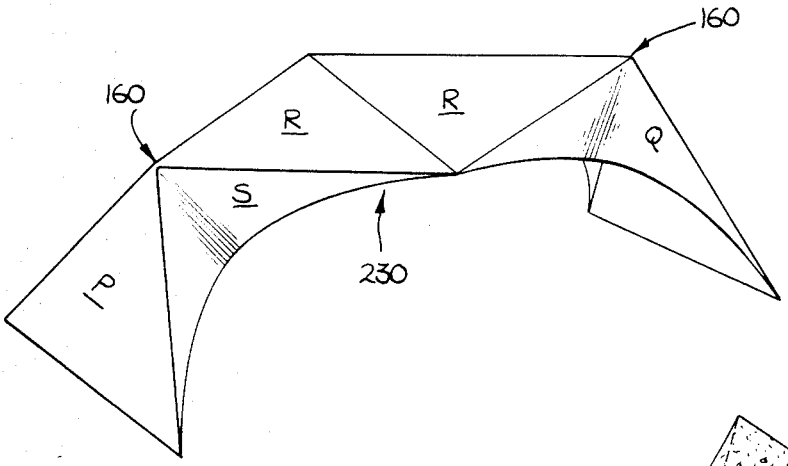
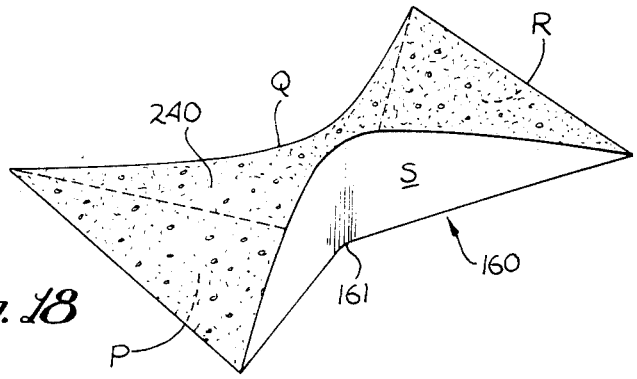
Fig. 18
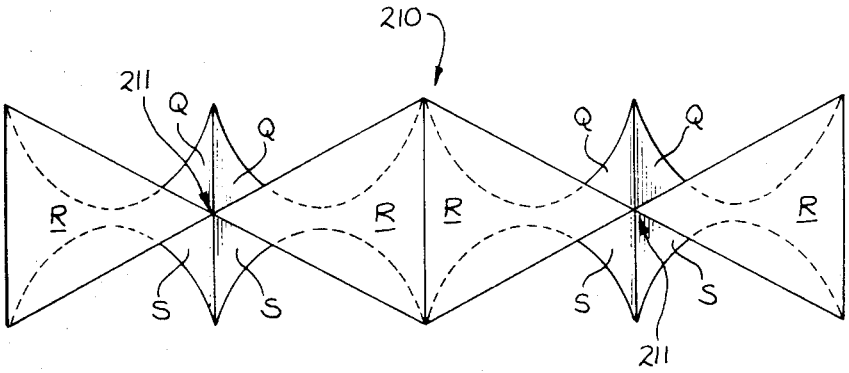
Fig. 15a

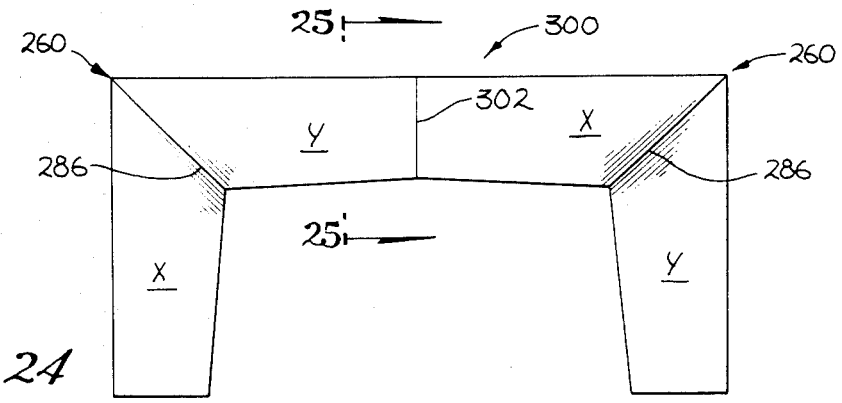
Fig. 24
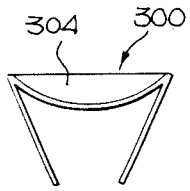
Fig. 25
Fig. 26
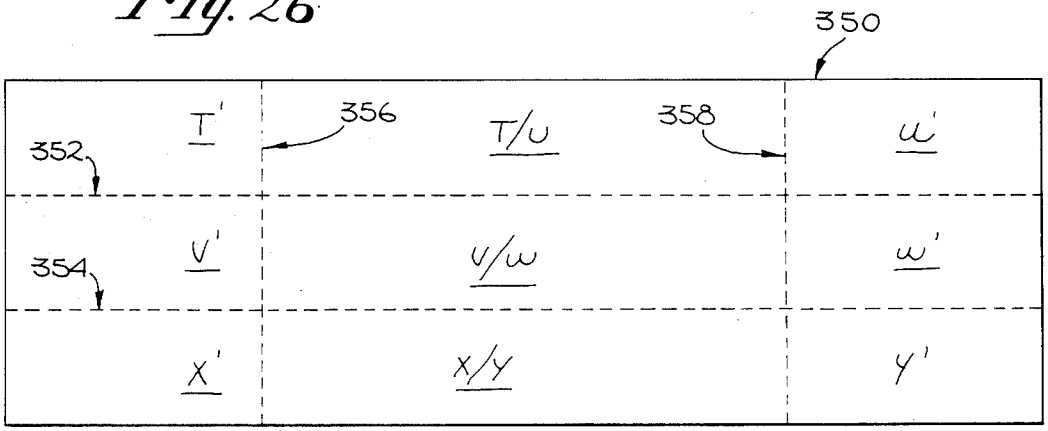
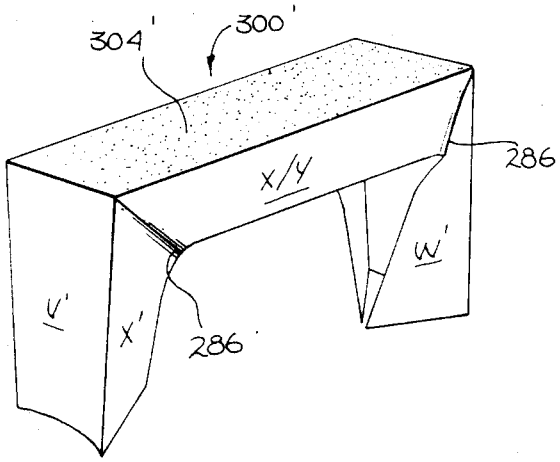
Fig. 27

STRUCTURAL MODULES

SUMMARY OF THE INVENTION

A new family of structural modules is disclosed, which can be described as pinched polyhedrons. The various modules in the family are each formed by folding and/or bending and pinching a polygonal sheet of flexible material, such as sheet steel, along a series of straight lines, to form a plurality of interconnected curved and flat surfaces which constitute the module. Many such modules may be appropriately interconnected as by bolts or welding to define a space enclosing structure suitable for a variety of purposes. While the shapes of the modules are most easily described by reference to folds, pinches and bends made to a sheet of material which may be a sheet of steel or a sheet of welded wire fabric it is apparent that the shapes may also be constructed by alternate methods, such as precasting and injection molding.

DESCRIPTION OF THE DRAWINGS

FIG. 4 is a perspective of an interconnection of 2 modules to form an alternate module.

FIG. 4*a* shows the bending lines which may be followed to form the alternate module of FIG. 4 from a single sheet of material.

FIG. 5 is a perspective of an interconnection of 6 modules as in FIGS. 2 and 3 to form a ring.

FIG. 14 is a low platform supported at each corner by a module as in FIGS. 11 and 12.

FIG. 15 is a side elevation of a truss constructed of interconnected modules as in FIGS. 11 and 12.

FIG. 15*a* is a top plan view of the truss of FIG. 15.

FIG. 16 is an elevated platform supported by an alternate interconnection of two modules as in FIGS. 11 and 12.

FIG. 16*a* is a detail view of the support of FIG. 16.

FIG. 17 shows a simple arch comprised of two interconnected modules of FIGS. 11 and 12.

FIG. 18 shows a single module filled with concrete.

FIG. 24 illustrates a method of interconnecting the element of FIG. 20 to form a simple arch.

FIG. 25 illustrates a variation on the construction of the arch of FIG. 24.

FIG. 26 shows a sheet of material with bend lines indicated.

FIG. 27 is a perspective of an arch formed by bending, folding and pinching the sheet along the bend lines shown in FIG. 26.

DETAILED DESCRIPTION OF THE INVENTION

Figure 1:
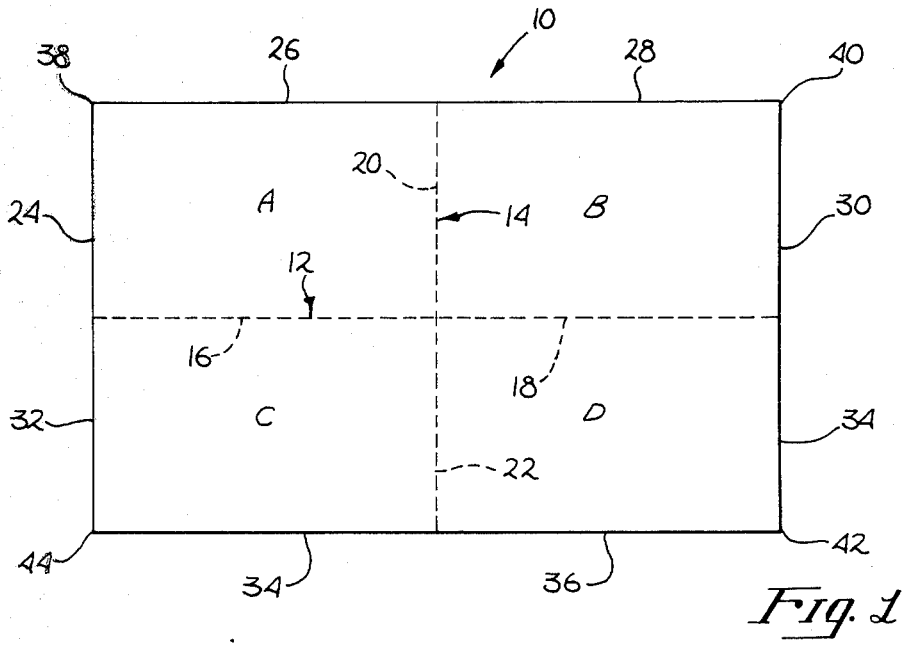
FIG. 1 is a plan view of a sheet of material with bend lines indicated.

The present invention comprises a family of structural modules, each of which has certain basic advantages over structural modules previously known and a method of creating such a structual modules. Complex modules are commonly fabricated away from the construction site and thus must be transported in their final shape to the site. This often results in uneconomical transportation of bulky and irregular shapes which are not easily packed for transporting or shipping.

The modules disclosed herein are easily fabricated at the construction site. Fabrication may begin with a flat sheet of metal such as steel or a flat sheet of welded wire fabric. A large sheet metal brake may be used to bend and "pinch" the sheet metal into the shape of the modules as disclosed. The advantages of such a module are many. Because shaping is performed onsite, no shipping of bulky or irregular shapes is required. Instead, the raw materials of flat sheet metal (or welded wire fabric), which are ideally suited for shipping, are trucked to the site. Use of low technology, large sheet metal brakes is all that is required to form the modules. The modules may easily be secured to one another by bolt connectors. Although the technology is simple, the resulting module may be interconnected with other similar modules (as well as with other generally simple planar members) to form complex structures previously obtainable only through use of much higher technology.

A particular characterizing feature of my present invention resides in providing a method of forming a family of structural modules which can be used to achieve a plurality of types of space defining structures such as truncated octahedrons and other triangulated structural frames, complex intersecting vaults and rectilinear port and beam construction as well as truss sections. The forms and generations of each of the disclosed structural modules are united by the common method of their formation as taught herein.

As used herein, the term "pinch generated" is intended to identify the ultimate characteristic curved surface shape of the structural modules as illustrated herein, regardless of whether the module was in fact formed by the pinch generation method (as more fully defined below) or by molding, or by any other method. Only two methods of forming the "pinch generated" modules are described herein, and the method of generation is not intended as a limitation of the invention.

As used herein, the term "pinch generated" implies the presence of at least three adjacent surfaces. The boundary of each surface is defined by a plurality of straight lines. The straight boundary lines bordering two adjacent surfaces become folding or bending lines as explained below.

A "pinch generated" structural module may be formed by beginning with a sheet of flexible material which may be sheet steel, a sheet of welded wire fabric, aluminum or other suitable material. The sheet may originally be flat, i.e., contained in a single plane. The flat sheet may be subdivided into a plurality of surfaces or fields which are preferably bounded by straight sides. This subdivision is accomplished by locating imaginary (or real) folding or bending lines on the sheet. The folding lines may extend radially from the center of the sheet and may either intersect at the center or merely radiate outward from the center (i.e., meet at the center but not intersect). The radially outward end of the folding lines may be located at corners of the sheet or may be located along an edge of the sheet, intermediate its corners.

The term "pinch generated" has been chosen to describe the characteristic curvature of the structural modules described herein, because a first surface of the at least three adjacent surfaces is folded or bent (i.e., pinched) about one fold line toward one other of said adjacent surfaces and is also folded or bent (i.e., pinched) about another fold line toward another of said adjacent surfaces. The amount of area of the first surface that is folded toward the other surfaces about the fold lines is not constant along the fold line, hence the first surface is caused to take on a curved shape. While the fold lines remain straight, at least one other straight line boundary of the first surface has been caused to curve out of the plane of the original sheet of material.

Figure 10:
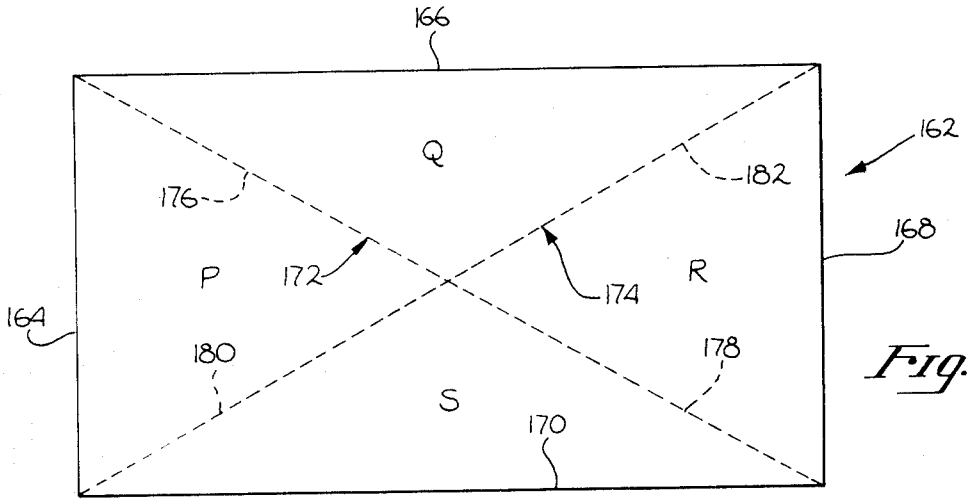
FIG. 10 is a plan view of a sheet of material with bend lines indicated.

When a single sheet is folded and pinched as described herein, the sheet is effectively divided into a plurality of panels with portions of the material in the panels being drawn together into abutting contact for a substantial distance to form struts. The struts may be integral with adjacent panels, such that portions of adjacent surfaces along said fold lines are drawn together, e.g. FIGS. 1–3, or portions of opposite panels are drawn together, e.g. FIGS. 10–12, or the struts may be formed from material at edges or boundaries of panels, e.g. FIG. 4. Ends of certain of the struts may be integrally joined to form a common node.

Figure 2:
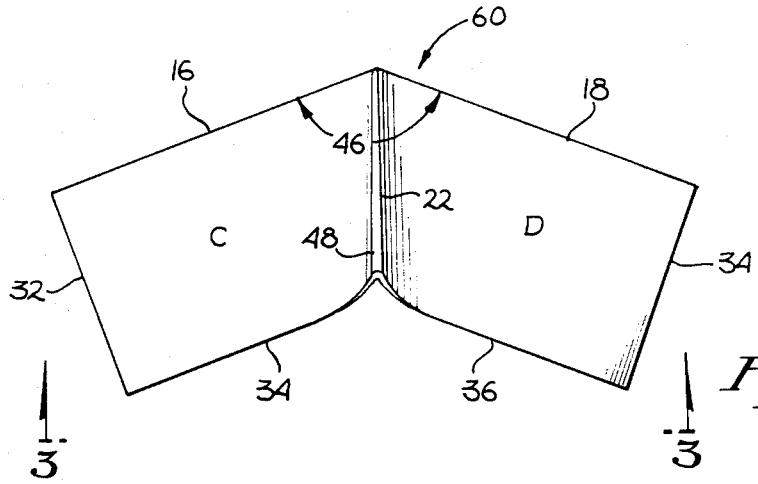
FIG. 2 is a side elevation of the new module.
Figure 3:
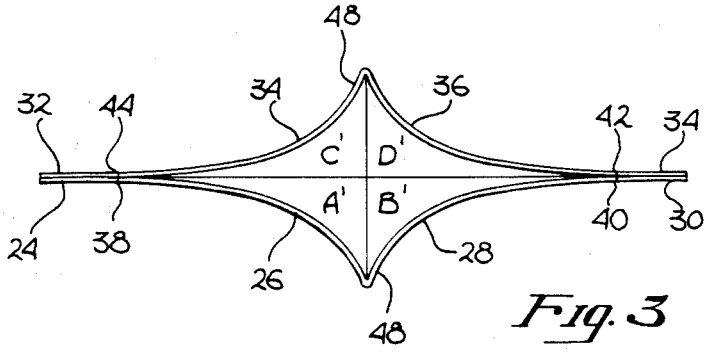
FIG. 3 is a view of a module taken in the direction of 3—3 of FIG. 2.

A specific illustration of this "pinch generated" method can be made with reference to FIGS. 1 through 3. Figure pairs 4, 4*a;* 10, 11; 19, 20; 26, 27; and 28, 29 could also serve to illustrate the method.

The first module 60 of the family is illustrated in FIGS. 1–3. The formation of the module 60 begins with a preferably rectangular flat sheet 10 of metal shown in FIG. 1. The rectangular sheet 10 is divided in half by each of two mutually perpendicular fold lines indicated by dashed lines 12 and 14. Line 12 is comprised of two segments of equal length, i.e., line 16 and line 18. Line 14 is also comprised of two segments of equal length, i.e., line 20 and line 22. The rectangular sheet 10 is thus divided into four surfaces. The first surface or panel A is bounded by edges 16, 20, 24 and 26. The second surface or panel B is bounded by edges 18, 20, 28 and 30. The third surface or panel C is bounded by edges 16, 22, 32 and 34. The fourth surface or panel D is bounded by edges 22, 18, 34 and 36. The edges 16, 18, 20 and 22 and the material drawn together adjacent these edges function as struts. The ends of the struts 16, 18, 20 and 22 at the edges 24, 32 and 30, 34 respectively, show where the struts fare away into the individual panels. For additional reference purposes, rectangular sheet 10 may be described as having corners 38, 40, 42 and 44. The region of the joinder of the struts 16, 18, 20 and 22 thus constitutes a node whichis integral with the struts and with the panels extending between the various struts.

By means of a sheet metal brake, the above described rectangular sheet 10 may be folded, bent and pinched to the shape of the module 60 of the present invention, illustrated in FIGS. 2 and 3. The bending, folding and pinching are performed along the dashed lines 12 and 14 of FIG. 1. The rectangular sheet 10 is bent about line 12 such that corner 38 is proximate and aligned with corner 44, and corner 40 is proximate and aligned with corner 42. In addition, the sheet 10 is bent about line 14 and pinched about line 14 where it meets edges 26 and 28 and edges 34 and 36. This bending continues until the included angle 46 between edges 16 and 18 (as shown in FIG. 2) reaches the desired measure. The pinching and bending if properly controlled, will produce the module 60 of FIGS. 2 and 3. Edges 26, 28, 34 and 36 will become curved and flanges 48 will result. The surfaces C and D will still be bounded by the same edges, but the surfaces will be partly flat and partly curved. The portion of surface C lying closer to edges 32 and 16 will be flat. The portion of surface C lying closer to edges 22 (which is straight) and 34 (which is now curved) will be curved. This curvature forms the flanges 48 and is best illustrated in FIG. 3.

FIG. 3 shows the folding of the edge 32 to overlie edge 24 and shows corners 42 and 44 overlying and coincident with corners 38 and 40. The underside of the four surfaces A, B, C and D are shown as A′, B′, C′ and D′ respectively. The flanges 48 and curved edges 26, 28, 34 and 36 are clearly illustrated.

From this description it is apparent that surfaces A, B, C and D are adjacent integral surfaces of the originally planar sheet 10 of material. Surface C has straight edges 16, 22, 32 and 34 with edges 16 and 22 constituting fold lines. The module shown in FIGS. 2 and 3 was formed by bending surface C about fold line 16 toward surface A and about fold line 22 toward surface D. Surfaces A, B and D were similarly folded about their fold lines toward similarly adjacent surfaces. As a result of this folding, each of surfaces A, B, C and D has become curved.

A first module 60 may be fastened end to end to a second module 60 as shown in FIG. 4. The fastening may be by welding, bolting or other suitable means along seam 61. The structure formed by joining of two modules 60 may itself be identified as a module 62. Module 62 may alternatively be formed in a manner similar to the formation of module 60. A rectangular sheet 63 (shown in FIG. 4*a*) may be divided by parallel fold lines 67 and divided by perpendicular fold line 65. By folding, bending and pinching sheet 63 in a manner analogous to the folding, bending and pinching of rectangular sheet 10, module 62 is readily formed without the presence of a seam 61 as shown in FIG. 4.

A plurality of modules 60 or modules 62 may be joined end to end with one another to define a ring 70 as shown in FIG. 5. As shown, ring 70 is hexagonal. However, if the included angle 46 between edges such as 16 and 18 of FIG. 2 is appropriately chosen, the ring 70 could easily be made to have any number of sides as desired within practical limitations. Thus, if the included angle 46 is made to be 135 degrees, the ring will be octagonal, 144 degrees produces a 10 sided ring, etc., which would employ 8 and 10 modules 60, respectively.

Figure 6:
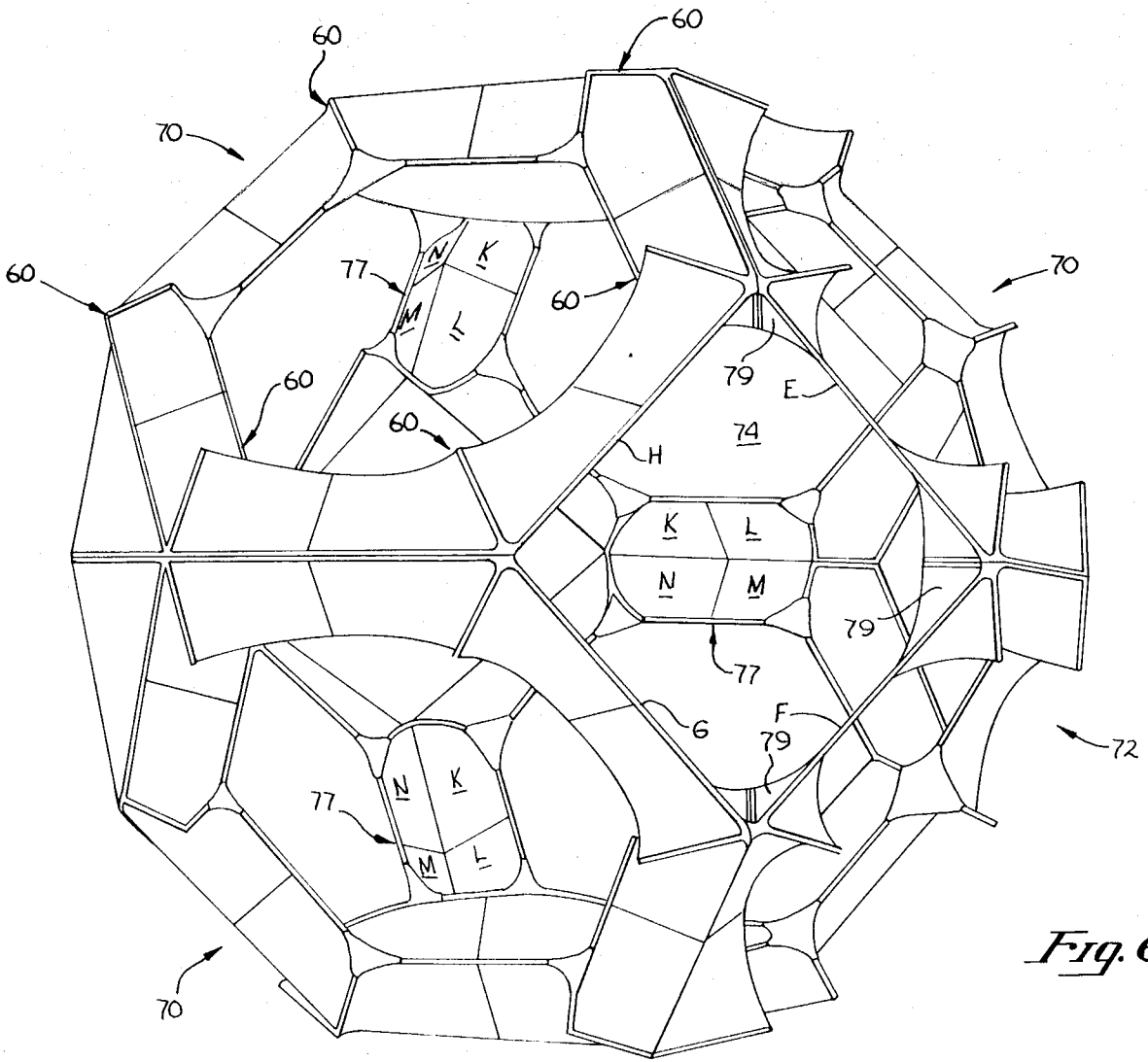
FIG. 6 is a perspective of an interconnection of 8 rings to form a sphere-like structure known as a truncated octahedron.

By appropriate interconnection and securing of a plurality of rings 70, a structure having the general shape of a sphere 72 may be constructed as shown in FIG. 6. As shown, the sphere 72 comprises eight such interconnected rings 70 each of which comprises six modules 60. Each half of the sphere 72 comprises four rings 70 joined to form a square aperture 74 defined by edges E, F, G and H. Of course, a greater or lesser number of rings 70 could be used to form sphere 72, in which case the aperture 74 would no longer be square (4 sided) but depending on the number of rings 70 used could be five sided, three sided, six sided, etc. (See FIG. 8.) Because flanges 48, and edges 16 and 18, occur throughout the structure of FIG. 6, foundation anchorage for the sphere 72 may occur at virtually any point on the sphere in three dimensions. This makes the structure easily adaptable for anchoring even on sloping grades.

Figure 7:
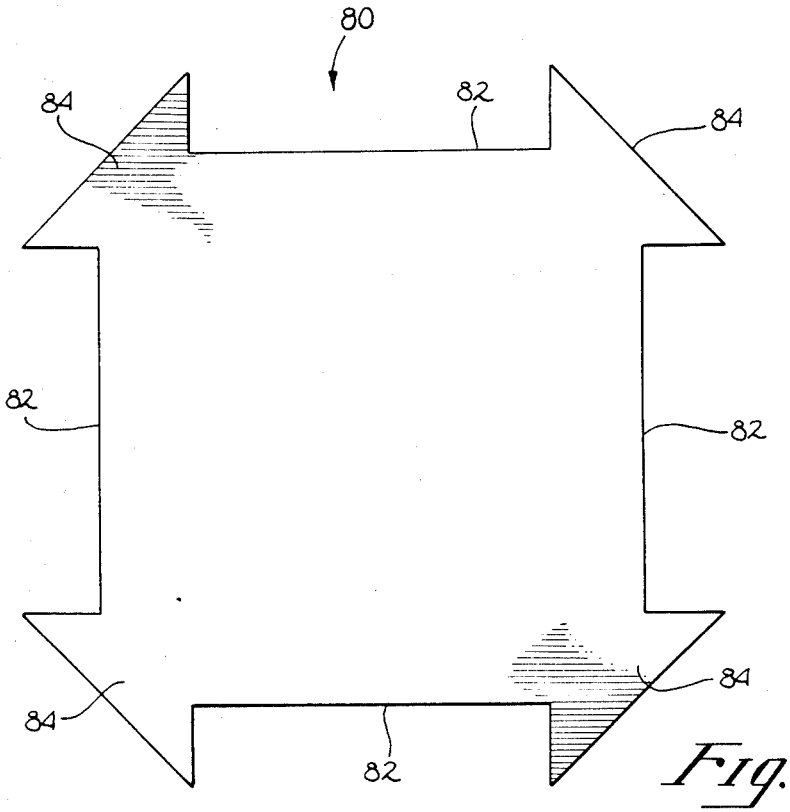
FIG. 7 shows a floor piece which may be fitted within the sphere of FIG. 6.
Figure 7A:
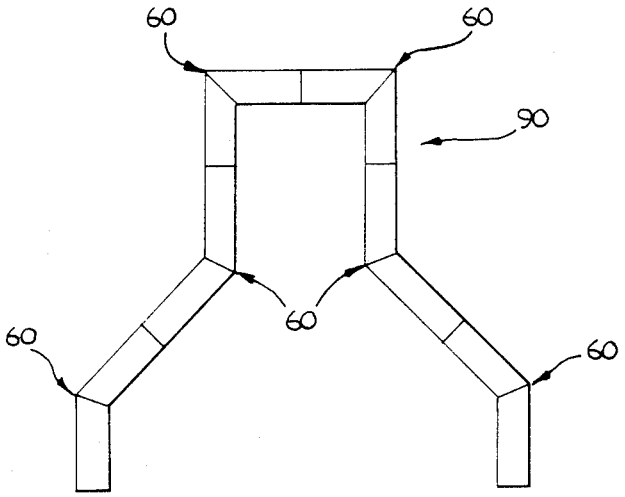
FIG. 7*a* shows a polygonal frame piece which may be constructed using the module of FIGS. 2 and 3.

On the interior side of sphere 72 are formed a number of generally oval cusps 77, defined by surfaces K, L, M and N. These cusps 77 can be used to secure a floor or ceiling member 80 within sphere 72 which divides the sphere 72 into an upper and lower half. The shape of the floor member 80 is shown in FIG. 7.

Floor member 80 is generally square and bounded by edges 82. The corners of this square are replaced by tabs 84 which are generally trapezoidal in cross section and which matingly fit into cusps 77 thereby securing the floor member 80 in position. Such a floor member 80 is secured in place merely by its placement within cusps 77 without need of any other fastening means.

It is, of course, contemplated that a number of spheres 72 may be interconected to provide structures of varied shape and size. The interconnections could continue indefinitely both horizontally, at an angle diagonally and vertically. The only limitation vertically is the strength of the material used to form modules 60 and their ability to withstand the resulting loading. The aperture 74 formed by joining a plurality of rings 70 serves as a convenient base for such spheres 72. The aperture 74 also serves, by reason of cusps 79 at each corner of the aperture 74, as a convenient means for seating and affixing exterior cladding or, depending on location, such cladding may serve as flooring. Spheres 72 may also be joined to one another at a respective aperture 74 of each sphere.

The modular structural element 60 is very versatile. It may be used to form any number of geometric and structural forms. One such form, a compound polygonal frame 90, is shown in FIG. *7a* comprised of 6 interconnected modular elements 60 having differing included angles 46. A plurality of such frames 90 could be interconnected and covered with an outer skin to form a tubular or tunnel-like structure.

Figure 8:
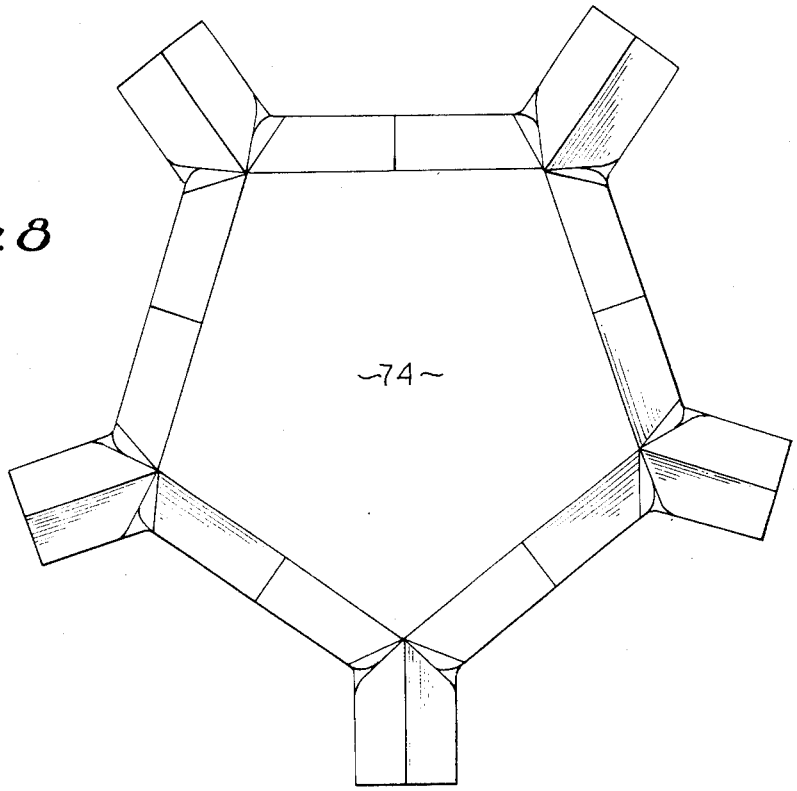
FIG. 8 shows a small portion of a 25 surfaced sphere-like structure comprised of 15 rings forming a pentagon where the rings are joined.

As mentioned above a number of rings 70 other than four may be joined together to define an aperture having other than four edges E, F, G and H. A five sided aperture 74 is illustrated in FIG. 8. The structure of FIG. 8 is of course only a small portion of a larger structure such as a sphere. A sphere constructed with five sided apertures 74 (similar to the four sided aperture 74 of FIG. 6) would comprise 15 rings 70 such as shown in FIG. 5.

Figure 9:
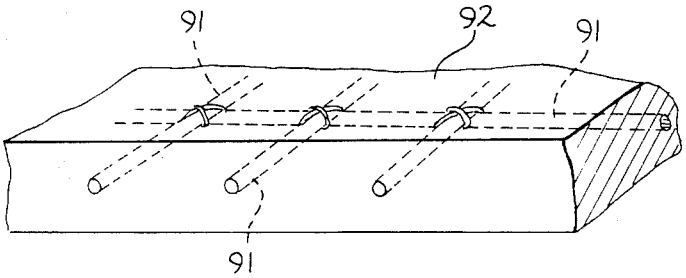
FIG. 9 shows an alternate form of construction of the representative module.

While the modules 60 thus far discussed have been described as if they were formed from sheet steel, it is contemplated that a variety of materials could be used depending on the particular installation design requirements. One variation in construction is shown in FIG. 9. The thin sheet of steel 10 is replaced by a mesh of wires 91 (commonly available in sheet form and known as welded wire fabric or electrically welded mesh), appropriately secured and formed to the shape of a modular element 60 and then coated with a layer 92 of concrete, or a combination, e.g. laminates of the sheet steel, wire fabric and concrete may be utilized. Whether formed as shown in FIG. 9 or by any other method the versatility of modular elements 60 is limited only by the architect's imagination.

Figure 11:
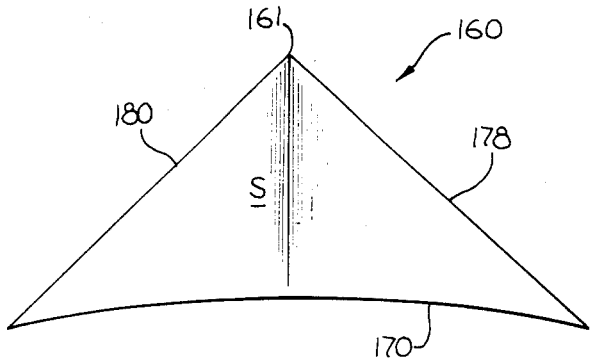
FIG. 11 is a side elevational view of the module formed by making the bends indicated in FIG. 10.

Another modular element 160, also formed by bending, folding and pinching sheet steel (as by a brake), or constructed of wire mesh and concrete as in FIG. 9, is shown in FIG. 11. This module 160 may also be formed beginning with a generally rectangular sheet 162 having sides 164, 166, 168, and 170. The module 160 is formed by bending and pinching sheet 162 along intersecting diagonal fold lines 172 and 174. Fold line 172 comprises equal length segments 176 and 178. Fold line 174 comprises equal length segments 180 and 182. The sheet 162 is comprised of four triangular surfaces, P, Q, R and S. Surface P is bounded by edges 164, 176 and 180. Surface Q is bounded by edges 176, 166 and 182. Surface R is bounded by edges 182, 168, and 178 and surface S is bounded by edges 170, 180 and 178. When sheet 162 is properly bent and pinched, the module 160 of FIGS. 11 and 12 is formed.

Figure 12:
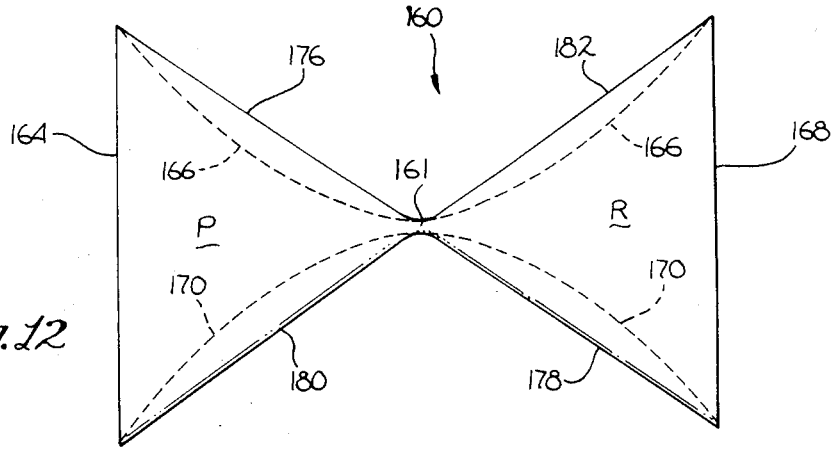
FIG. 12 is a top plan view of the module of FIG. 11.

The process of bending and pinching the sheet 162 causes edges 166 and 170 to become curved as shown in FIG. 12 and also to become slightly curved out of the horizontal plane as shown in FIG. 11. Surfaces S and Q become highly curved at edges 170 and 166 respectively and gradually fair into the straight edges 180, 178 and 176, 182 respectively.

A top view of the module 160 shows that surfaces P and R remained virtually triangular with all straight edges. A plurality of modules 160 may be interconnected in a wide variety of manners to produce structures of myriad shapes as illustrated in FIGS. 13 through 17. Such structures are inherently adapted to pre-stressing and or post-tensioning as for example about the lines 164 and 168 of FIG. 12, or lines 168 of FIG. 13.

Figure 13:
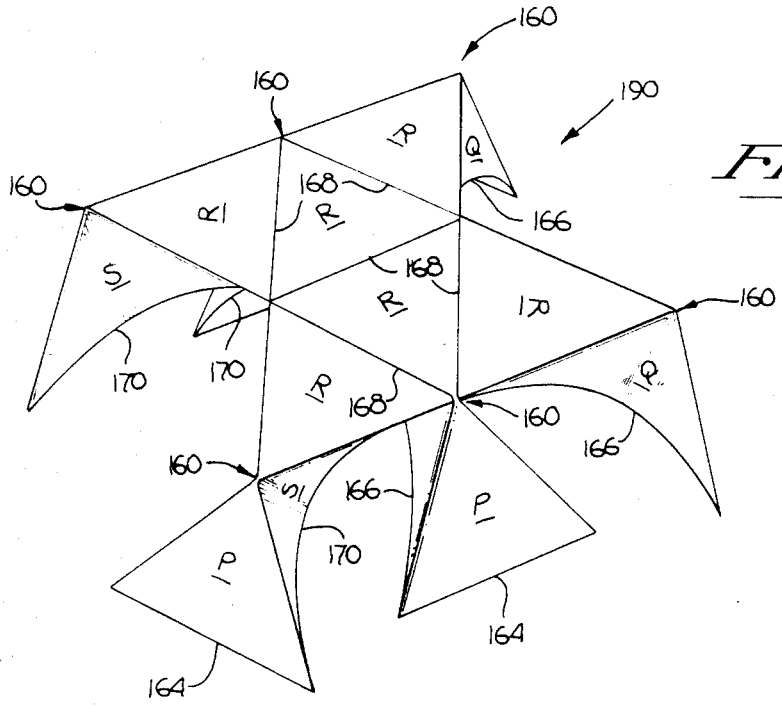
FIG. 13 shows a structure comprised of 6 interconnected modules of FIGS. 11 and 12.
Figure 19:
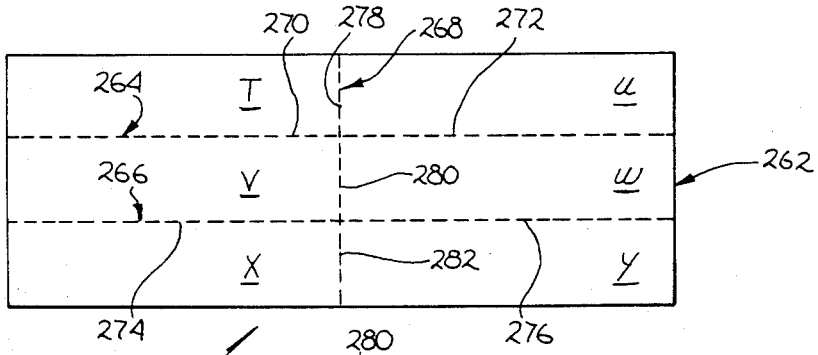
FIG. 19 is a plan view of a sheet of material with bend lines indicated thereon.

A one story open sided structure 190 as shown in FIG. 13 comprises six interconnected modular elements 160. The upper surface of structure 190 comprises six surfaces R and is supported by six partial walls comprised of surfaces P having their edges 164 resting on ground. If desired the open portions of the walls could be closed or covered by a suitable skin material not shown. It should be noted, as is obvious from FIG. 13 that closure of such open portions requires only simple shaped polygonal surfaces having no curved surfaces. A plurality of structures 190 may be course be interconnected in a single plane or stacked vertically to form multi-level structures.

Depending on the size of modular elements 160, the structure 200 shown in FIG. 14 could serve as a low platform, a stage or an open sided canopy under which persons could congregate or under which any other appropriate event could be held. Such a structure would comprise a simple sheet member 202 supported as appropriate by a plurality of modular elements 160. This structure 200 could also be joined to others and stacked vertically to form a multi level structure.

A pair of modular elements 160 may also be joined to one another at their respective surfaces R (or P). A plurality of such joined pairs could then be interconnected as in FIG. 15 to form a truss 210. A top view of truss 210 would be as shown in FIG. 15*a*, the length of such truss 210 being whatever is suitable in the particular application. Two trusses 210 could be placed side by side and staggered with respect to one another (not shown) to provide a top surface having a useful width which did not approach zero as at 211 in FIG. 15*a*. Tie rods 212 may to used to secure the lower end of each pair of modules 160 to the lower end of an adjacent pair of modules. Such a structure could serve as a span or bridge section. A similar method may be used to obtain other different truss sections when module 160 is formed by pinch generation along the diagonals of an essentially square sheet of material, or rectangular sheets having proportions different from those shown in FIG. 10.

For various reasons it may be desirable to support the stage or platform 202 in FIG. 14 by a plurality of modular elements 160 interconnected as shown in FIG. 16 and in greater detail in FIG. 16*a*. The sheet element 202 is supported as appropriate by an interconnected plurality of modular elements 160 reinforced by a beam or tie-rod 220. Instead of only two modular elements 160, many elements 160 could be connected with an appropriate number of tie rods 220, as required to raise sheet element 202 to the desired height.

A simple arch 230 may be formed by joining two modular elements 160 as shown in FIG. 17. A plurality of such arches 230 may be joined to one another to define extended structures as desired.

As thus far described, the modular element 160 comprises a shell-like structure defined by the four surfaces P, Q, R and S. If the modular element 160 is inverted, i.e., its apex 161 is placed vertically downward, as in FIG. 18, it is apparent that the volume bounded by surfaces P, Q, R and S could contain a fluid. It is contemplated that the volume may also be filed with a solid such as concrete 240 or any other solid suitable to the application. Thus, solid plastic, wood, and glass may be suitable depending on the application. The modular element 160 as filled with concrete 240 would exhibit strength characteristics making the element 160 more suited to particular applications than if the element 160 were hollow. The element 160 could also be formed of a concrete coated sheet of steel wire mesh as illustrated in FIG. 9, which might thereafter remain hollow or also be filled with concrete as desired.

Figure 20:
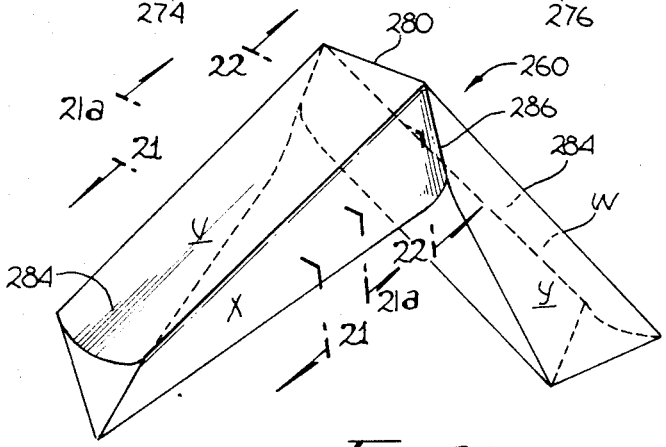
FIG. 20 is a perspective of a modular construction element formed from the sheet of FIG. 19.

A third modular element 260 which may also be formed by bending, folding and pinching a sheet of steel along fold lines is illustrated in FIG. 20. This modular element 260 may be formed from a generally rectangular sheet of metal 262. Two parallel bend lines 264 and 266 divide the width of sheet 262 into thirds. The length of sheet 262 is divided in half by a bend line 268 perpendicular to the bend lines 264 and 266. Bend line 264 comprises two segments, lines 270 and 272. Bend line 266 also comprises two segments, lines 274 and 276. Bend line 268 comprises three segments 278, 280 and 282. Sheet 262 is thus divided into six surfaces T, U, V, W, X, and Y.

Figure 21:
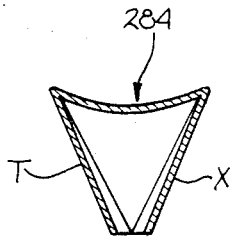
FIG. 21 is a cross section taken along the line 21—21 of FIG. 20.
Figure 21A:
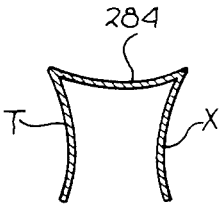
FIG. 21*a* is a cross section taken along line 21*a*—21*a* of FIG. 20.
Figure 22:
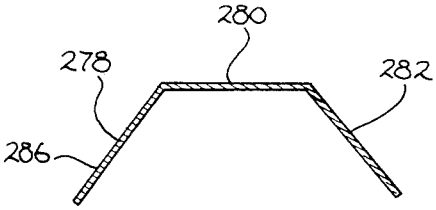
FIG. 22 is a cross section taken along the line 22—22 of FIG. 20.
Figure 23:
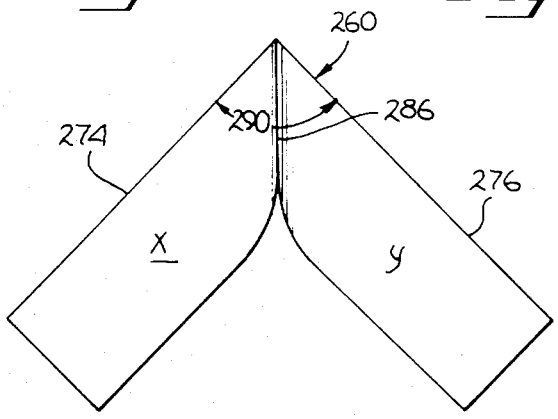
FIG. 23 is a side elevation of the modular construction element of FIG. 20.

When rectangular sheet 262 is properly bent, folded and pinched along the bending lines 264, 266 and 268, the modular element 260 of FIG. 20 is formed. The cross section of element 260 is generally tubular and is somewhat triangular at its ends as shown in FIG. 20. Intermediate the center of element 260 and its ends, the cross section resembles that shown in FIG. 21. In the center of element 260 the cross section is as shown in FIG. 22. The bending, folding and pinching changes surfaces V and W into a trough like hollow 284 and forms flanges 286. A side elevational view of element 260 is shown in FIG. 23. The angle 290 may be varied to permit joining a plurality of elements 260 as desired, e.g., to form various structural forms, arches or rings as was discussed with reference to module 60.

FIG. 24 illustrates one specific such structure, arch 300 comprised of two elements 260 joined at seam 302. The generally triangular shaped end of element 260 provides inherently stable footing for the element 260 where it meets the ground plane. A useful variation on the arch 300 is the filling of the trough 284 with concrete 304 as shown in cross section in FIG. 25. If sheet steel is used to form the elements 260, this variation provides the ideal wedding of concrete and steel. Assuming such an arch 300 is to bear some loading, the concrete 304 would be placed in compression for which concrete is ideally suited, and the steel would be placed in tension for which steel is ideally suited. The arch 300 would thus use both steel and concrete to their respective best advantage, forming what is known as composite construction.

The arch 300' could also be formed from a single sheet of steel 350 having bend lines 352, 354, 356 and 358 as shown in FIG. 26. When properly bent, folded and pinched a unitary arch 300' as shown in FIG. 27 would be formed which would not have a seam 302 such as shown in FIG. 24 with respect to arch 300. In so forming arch 300' the surface v/w could be made to form a trough which could be filled with concrete 304' as shown in FIG. 27.

Figure 28:
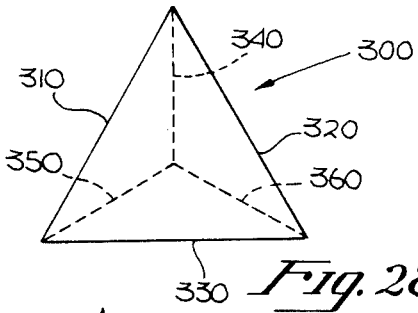
FIG. 28 is a plan view of a triangular sheet of material with fold lines indicated.
Figure 29:
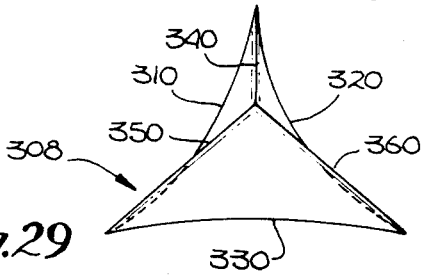
FIG. 29 is a perspective view of the module formed by folding the sheet of FIG. 28.

FIGS. 28 and 29 illustrate another embodiment of a pinch generated module wherein the fold lines do not intersect but rather radiate from a given point. FIG. 28 shows a triangular sheet 300 having sides or borders 310, 320 and 330. The center of the triangular sheet 300 is joined to each apex of the triangular sheet by fold lines 340, 350 and 360. When the three defined surfaces located between the fold lines are drawn or folded toward one another the structural module 308 of FIG. 29 results. A similar folding procedure could of course be followed for sheets having the shape of a pentagon, a hexagon, or any polygon generally, to produce modules of correspondingly different shapes.

While a plurality of modules of various shapes have been described, they each have a number of common features. For example, each is basically a shell-like structure having its shape defined by a relatively thin exterior sheet material which has been pinched, as previously described. The sheet material thus encloses and defines an interior volume. The interior volume of each module can be filled with concrete or other solidifying material to form a solid module. The module thus is capable of serving as a mold for itself, which mold does not have to be removed when the module is used in a structure. The entire module, exterior sheet steel skin and interior concrete volume can be used as a structural module. The mold (sheet steel) is not required to be removed (see FIG. 18).

Each of the various modular elements may be interconnected with other identical modules to form a variety of basic geometric shapes and structures. The finished shapes or structures have exterior surfaces which are readily clad with sheet material to enclose the structure. For example, in FIG. 6, the square aperture 74, defined by edges E, F, G and H, is readily clad with a flat sheet of material, e.g., sheet steel. Even the exterior side of the hexagonal rings 70 are easily clad with simple shaped sheet material. These sheets of cladding may also, if appropriately secured to the modules, serve as a structural diaphragm member to assist in bearing and redistributing loading. The area bounded by two adjacent flanges 48 and one edge of the hexagonal ring (such as edge E or H) can be covered with a flat generally trapezoidal sheet. If all such surfaces of a given ring are similarly covered, a flat hexagonal sperture will remain, formed by the six trapezoidal sheets just described. This aperture may be closed by a flat hexagonal sheet. Alternatively, the six trapezoidal sheets and the central hexagonal sheet can be integrally cut from a single sheet and appropriately bent where the trapezoidal sections join the hexagonal section, and the entire unitary sheet can be placed over the hexagonal ring and secured thereto. An entire "spherelike" structure such as in FIG. 6, can therefore be easily clad to enclose the interior volume. The other structures, such as illustrated in FIGS. 13 and 17 can also be clad without the use of curved surfaces.

In the various structures described, the floor and/or wall members (i.e., cladding) will not only serve as floor or wall but also act as a diaphragm, and share in and relieve the loading applied to the structure.

Another characteristic of each of the modules discussed is that no connectors are needed. As is well known to persons in the fields of architecture and structural engineering, most structures are composed of a framework having beams and columns (ie., struts) and connectors. Connectors are those members located at a conjunction of struts, connected to each strut, and holding the struts in their positional relationship with the other struts secured to the connector. As an illustration, one may refer to U.S. Pat. No. 3,600,825 issued to Pearce for a complete discussion of nodes (connectors) and struts, and specifically to FIGS. 1, 8 and 25. In FIG. 25 are shown connectors 25 and struts 110*a*. Additional reference may be made to Fuller (U.S. Pat. No. 3,354,591) which in FIGS. 3 and 16 shows connectors 1,2,3 and 7 and struts 4, 5, 6, 4*a*, 5*a*, 6*a*, etc. In contrast with these systems, the modular elements described herein require no connectors. The modules themselves are the connectors and struts. The "strut" portion and "connector" portions merge into one another and are indistinguishable.

Each of the modules discussed herein may be formed of a flat sheet of steel. Thus flat sheets of steel may be delivered to a worksite and a large sheet metal brake can be used to form the module at the site of construction. By using modules formed according to the same method of the present invention, vastly different structures such as triangulated frameworks, truncated octohedrons, complex intersecting vaults, rectilinear post and beam construction and truss sections may be constructed.

By use of modules according to the invention, complex structures and simple structures alike may be fabricated from a minimal number of structural elements. This minimal number of elements comprises only (1) the particular module chosen, (2) the shape or shapes of panel members to form the skin or floors of the structure, and (3) the bolts necessary to secure one module to another. As an example, the structure in FIG. 6 is formed of the module 60, uses as skin panels a square panel and a generally hexagonal panel to cover the exterior surface of a given ring 70, and uses the floor panel 80 shown in FIG. 7. The same module may be used to form structures of other shapes which would, of course, require different shaped skin panels.

While the discussion of the several embodiments of the invention has been with reference to FIGS. 1 through 29, the figures are for purposes of illustration only and should not be interpreted as limitations upon the invention. It should be understood that various changes in material and construction may be made to the construction modules disclosed herein, by one of ordinary skill in the art, without departing from the spirit and scope of the invention, which is intended to be defined and limited solely by the appended claims.

What is claimed is:

1. A complex, substantially polyhedral, three-dimensional space enclosing module for forming in conjunction with other similar modules, space enclosing structures and space enclosing structural frameworks, the module comprising:

a structure defined by four surfaces with each surface being bounded by four edges;

two of such edges being straight and forming a right angle and defining a plane;

a third of said four edges also being straight and intersecting said plane;

said third edge being connected to a first of said two straight edges by a curved fourth edge thereby closing the surface;

said four surfaces being joined in pairs along at least one of said two straight edges; and said pairs being joined together along the respective pairs of said third edges.

2. The module according to claim 1 wherein said at least one of said two straight edges of one joined pair of surfaces forms an included angle of 120 degrees with the at least one of said two straight edges of the other joined pair of surfaces.

3. The module according to claim 1 wherein said at least one of said two straight edges of one joined pair of surfaces forms an included angle with the at least one of said two straight edges of the other joined pair of surfaces ranging from 45 degrees up to 180 degrees.

4. A complex, substantially polyhedral three-dimensional module for defining, in conjunction with other similar modules, space enclosing structures and space enclosing structural frameworks, the module comprising a plurality of modules according to claim 1 joined edge to edge to one another.

5. A module according to claim 4 wherein said plurality of modules are joined end to end to one another to form a closed ring.

6. A plurality of modules according to claim 5 joined to one another to enclose a generally spherical space.

7. A module according to claim 1 formed by bending and pinching a rectangular sheet of flexible metal material along mutually perpendicular bending lines and each of which bisects said sheet and is perpendicular to two sides of said rectangle.

8. A module according to claim 1 comprised of a surface coating of concrete over a folded rectangular sheet of wire mesh defining said module.

9. A module according to claim 1 formed by injection molding.

10. A module according to claim 1 formed by casting.

11. A complex, substantially polyhedral three-dimensional module for defining, in conjunction with other similar modules, space enclosing structures and space enclosing structural frameworks, the module having a shape substantially identical to the shape that results from joining at least two modules according to claim 1, end to end to one another.

12. A complex, substantially polyhedral, three-dimensional module for defining, in conjunction with other similar modules, space enclosing structures, the module comprising:

a structure defined by at least three surfaces formed from a polygonal sheet of material, at least two of said surfaces being curved surfaces, each surface being bounded by at least three edges;

at least two of such edges being straight and substantially meeting each other at a point, a third of said edges being curved and meeting at least one of said two straight edges, said third edge being connected to said two straight edges by one of said two curved surfaces, said three surfaces being joined in pairs along at least one of said two straight edges, said pairs being joined together along at least one of said two straight edges.

13. The module according to claim 12 in which an outward end of one of said two straight edges is located at a corner of said polygonal sheet material, not along a straight side of said polygonal sheet material.

14. The module according to claim 12 in which an outward end of one of said two straight edges is located along a straight side of said polygonal sheet material, not at a corner of said polygonal sheet material.

15. The module according to claim 12 in which said two straight edges are oriented to each other in a perpendicular manner.

16. The module according to claim 12 in which said two straight edges are oriented to each other in a non-perpendicular manner.

17. The module according to claim 12 in which at least two modules according to claims 13–16 are joined together in a single more complex module.

18. The module according to claim 12 formed by a method of folding said sheet material along said straight edges, such that said two curved surfaces are pinched towards each other thereby becoming proximate and aligned, coincident and overlying each other at at least one of their corners and along a portion of one of said three edges.

* * * * *